US011293647B2

(12) United States Patent
Sanada et al.

(10) Patent No.: US 11,293,647 B2
(45) Date of Patent: Apr. 5, 2022

(54) AIR CONDITIONER

(71) Applicant: FUJITSU GENERAL LIMITED, Kawasaki (JP)

(72) Inventors: Shintaro Sanada, Kawasaki (JP); Shunji Itakura, Kawasaki (JP); Yu Hirosaki, Kawasaki (JP)

(73) Assignee: FUJITSU GENERAL LIMITED, Kawasaki (JP)

( * ) Notice: Subject to any disclaimer, the term of this patent is extended or adjusted under 35 U.S.C. 154(b) by 1 day.

(21) Appl. No.: 16/621,496

(22) PCT Filed: Mar. 28, 2018

(86) PCT No.: PCT/JP2018/013048
§ 371 (c)(1),
(2) Date: Dec. 11, 2019

(87) PCT Pub. No.: WO2019/003532
PCT Pub. Date: Jan. 3, 2019

(65) Prior Publication Data

US 2020/0158352 A1 May 21, 2020

(30) Foreign Application Priority Data

Jun. 30, 2017 (JP) ..... JP2017-128449

(51) Int. Cl.
*F24F 1/0007* (2019.01)
*F24F 1/0059* (2019.01)

(52) U.S. Cl.
CPC ..... *F24F 1/0059* (2013.01); *F24F 1/00075* (2019.02); *F24F 1/00077* (2019.02)

(58) Field of Classification Search
CPC ..... F25B 2345/001; F25B 2345/003; F25B 2345/00; F25B 45/00; F25B 40/02;
(Continued)

(56) References Cited

U.S. PATENT DOCUMENTS

2006/0144059 A1 7/2006 Kang et al.
2008/0209926 A1 9/2008 Matsuoka et al.
(Continued)

FOREIGN PATENT DOCUMENTS

CN 1965203 A 5/2007
CN 101166941 A 4/2008
(Continued)

OTHER PUBLICATIONS

English language translation of JP2010-65999 (Year: 2010).*
(Continued)

*Primary Examiner* — Cassey D Bauer
(74) *Attorney, Agent, or Firm* — Arent Fox LLP; Michael Fainberg

(57) ABSTRACT

The amount of refrigerant to be charged in a refrigerant circuit of an air conditioner is set to a range defined by a lower-limit charge amount and an upper-limit charge amount. The lower-limit charge amount is a charge amount with which a refrigerant supercooling degree is 0 deg and a refrigerant quality is 0 at a refrigerant outlet side of a supercooling heat exchanger when a cooling operation is performed under an overload condition in which the refrigerant is hardly condensed in an outdoor heat exchanger that functions as a condenser. On the other hand, the upper-limit charge amount is a charge amount with which a refrigerant supercooling degree is 0 deg and a refrigerant quality is 0 at a refrigerant outlet side of the outdoor heat exchanger when the cooling operation is performed under a rated condition.

1 Claim, 2 Drawing Sheets

(58) Field of Classification Search
CPC ..... F25B 2700/131; F24F 1/0059; F24F 1/00077; F24F 1/00075
See application file for complete search history.

(56) References Cited

U.S. PATENT DOCUMENTS

| | | | | |
|---|---|---|---|---|
| 2009/0151374 | A1 | 6/2009 | Kasahara | |
| 2011/0308267 | A1* | 12/2011 | Tamaki | F25B 45/00 62/222 |
| 2012/0280816 | A1 | 11/2012 | Gado et al. | |
| 2015/0267951 | A1 | 9/2015 | Berg et al. | |

FOREIGN PATENT DOCUMENTS

| | | | | |
|---|---|---|---|---|
| CN | 101331370 | A | | 12/2008 |
| CN | 103502750 | | | 1/2014 |
| EP | 2562493 | A | | 2/2013 |
| JP | 03177762 | A | | 8/1991 |
| JP | 2001227822 | A | | 8/2001 |
| JP | 2008045792 | A | | 2/2008 |
| JP | 2009115340 | A | | 5/2009 |
| JP | 2010065999 | A | | 3/2010 |
| JP | 2013-139948 | | * | 7/2013 |
| JP | 2015105808 | A | | 6/2015 |
| JP | 2016099056 | A | | 5/2016 |
| WO | 2008079108 | A1 | | 7/2008 |

OTHER PUBLICATIONS

International Search Report issued in PCT/JP2018/013048, dated Jun. 12, 2018.
Supplementary European Search Report issued in PCT/JP2018/013048, dated Mar. 8, 2021.

* cited by examiner (A)

(B)

(A)

(B)

AIR CONDITIONER

CROSS-REFERENCE TO RELATED APPLICATIONS

This application is a National Stage Entry of PCT/JP2018/013048, filed Mar. 28, 2018, which claims priority to Japanese Patent Application No. 2017-128449, filed Jun. 30, 2017, the disclosures of each of which are hereby incorporated in their entireties.

TECHNICAL FIELD

The present invention relates to an air conditioner using a refrigerant.

BACKGROUND ART

Conventionally, an air conditioner having a refrigerant circuit in which at least one outdoor unit and at least one indoor unit are connected by a refrigerant pipe drives compressor provided in the outdoor unit such that refrigerant charged in the refrigerant circuit is circulated inside the refrigerant circuit so as to perform a cooling operation or a heating operation. In addition, there is an air conditioner that includes a bypass pipe, which causes a part of refrigerant flowing out of an outdoor heat exchanger functioning as a condenser during a cooling operation to branch off and return to a suction side of a compressor in the above-described refrigerant circuit, and a supercooling heat exchanger which cools the refrigerant flowing out of the outdoor heat exchanger by the refrigerant flowing through the bypass pipe (for example, see Patent Document 1).

In the air conditioner as described above, the refrigerant circuit is charged with a predetermined amount (a sufficient amount for exhibition of the operation capability requested by the installed air conditioner) of refrigerant. Examples of the refrigerant to be charged in the refrigerant circuit include HFC refrigerant such as R410A that is nonflammable but has a high global warming potential (GWP, hereinafter referred to as "GWP"), R32 that has a low GWP but is slightly flammable (HFC refrigerant without carbon double bond in its composition), HFO-1234yf (HFC refrigerant having a halogenated hydrocarbon in the composition, expressed as "HFO refrigerant"), and the like.

In recent years, it is requested to reduce the amount of refrigerant to be charged in the refrigerant circuit in the case of using refrigerant having a high GWP in order to prevent global warming. In addition, even in the case of using low GWP refrigerant, the refrigerant is slightly flammable as described above, and thus, it is desirable to reduce the amount of refrigerant to be charged in the refrigerant circuit as much as possible in order to prevent the density of refrigerant leaking from the refrigerant circuit from becoming a concentration that leads to ignition.

CITATION LIST

Patent Citation

Patent Document 1: JP 2010-65999 A

SUMMARY OF INVENTION

Technical Problem

As the amount of refrigerant to be charged in the refrigerant circuit decreases, a condensation pressure in a heat exchanger functioning as a condenser (an outdoor heat exchanger during a cooling operation/an indoor heat exchanger during a heating operation) decreases and a condensation temperature is lowered. When the condensation temperature is lowered, a temperature difference between refrigerant inside the condenser and air (outside air during the cooling operation/indoor air during the heating operation) decreases so that there is a concern that the air conditioning capacity of the air conditioner may deteriorate due to a decrease in the condensation capacity.

In addition, when the condensation temperature is lowered so that the temperature difference between the refrigerant and the air inside the condenser decreases, there is a concern that refrigerant flowing out of the condenser may become a gas-liquid two-phase state without being fully condensed, and there is a problem that refrigerant sound is generated when the refrigerant in the gas-liquid two-phase state passes through an expansion valve. Furthermore, there is a problem that the controllability of the expansion valve deteriorates when the refrigerant in the gas-liquid two-phase state passes through the expansion valve. Such a problem of the deterioration of the controllability occurs because an opening degree of the expansion valve is normally adjusted assuming passage of liquid refrigerant. Since a ratio of gas refrigerant to liquid refrigerant is unknown in the refrigerant in the gas-liquid two-phase state, it is difficult to perform appropriate control of a refrigerant flow rate with the adjustment of the opening degree of the expansion valve assuming the passage of the liquid refrigerant.

The present invention solves the above-described problems, and an object thereof is to provide an air conditioner capable of reducing the amount of refrigerant to be charged in a refrigerant circuit while eliminating problems such as deterioration of controllability of an expansion valve and generation of refrigerant sound and preventing deterioration of air-conditioning performance.

Solution to Problem

To solve the aforementioned problems, an air conditioner according to the present invention includes: an outdoor unit having a compressor and an outdoor heat exchanger; an indoor unit having an indoor heat exchanger, the outdoor unit and the indoor unit connected by a liquid pipe and a gas pipe to constitute a refrigerant circuit; and an expansion valve provided in the outdoor unit, the indoor unit, or the liquid pipe or any combination thereof, wherein a charge amount of refrigerant to be charged in the refrigerant circuit is set to a charge amount that is larger than a lower-limit charge amount and smaller than an upper-limit charge amount. The upper-limit charge amount is a charge amount with which a refrigerant supercooling degree of refrigerant at a refrigerant outlet of the outdoor heat exchanger or the indoor heat exchanger that functions as a condenser is 0 deg and a refrigerant quality at the refrigerant outlet of the outdoor heat exchanger or the indoor heat exchanger that functions as the condenser is 0 when a cooling operation or a heating operation is performed under a predetermined rated condition. The lower-limit charge amount is a charge amount with which a refrigerant supercooling degree at a refrigerant inlet of the expansion valve is 0 deg, and a refrigerant quality at the refrigerant inlet of the expansion valve is 0 when a cooling operation or a heating operation is performed under a predetermined overload condition in which a temperature difference between a refrigerant condensation temperature in the outdoor heat exchanger or the indoor heat exchanger that functions as the condenser and a temperature of air that is sucked into the outdoor unit or the indoor unit to exchange heat with the refrigerant inside the condenser becomes smaller than the rated condition.

Advantageous Effects of Invention

According to the air conditioner of the present invention configured as described above, it is possible to reduce the charge amount of refrigerant to be charged in the refrigerant circuit while eliminating the problems such as the deterioration of controllability and the generation of refrigerant sound and preventing the deterioration of air-conditioning performance by setting the amount of refrigerant to be charged in the refrigerant circuit to the charge amount larger than the lower-limit charge amount and smaller than the upper-limit charge amount.

EMBODIMENTS FOR CARRYING OUT THE INVENTION

Figure 1:
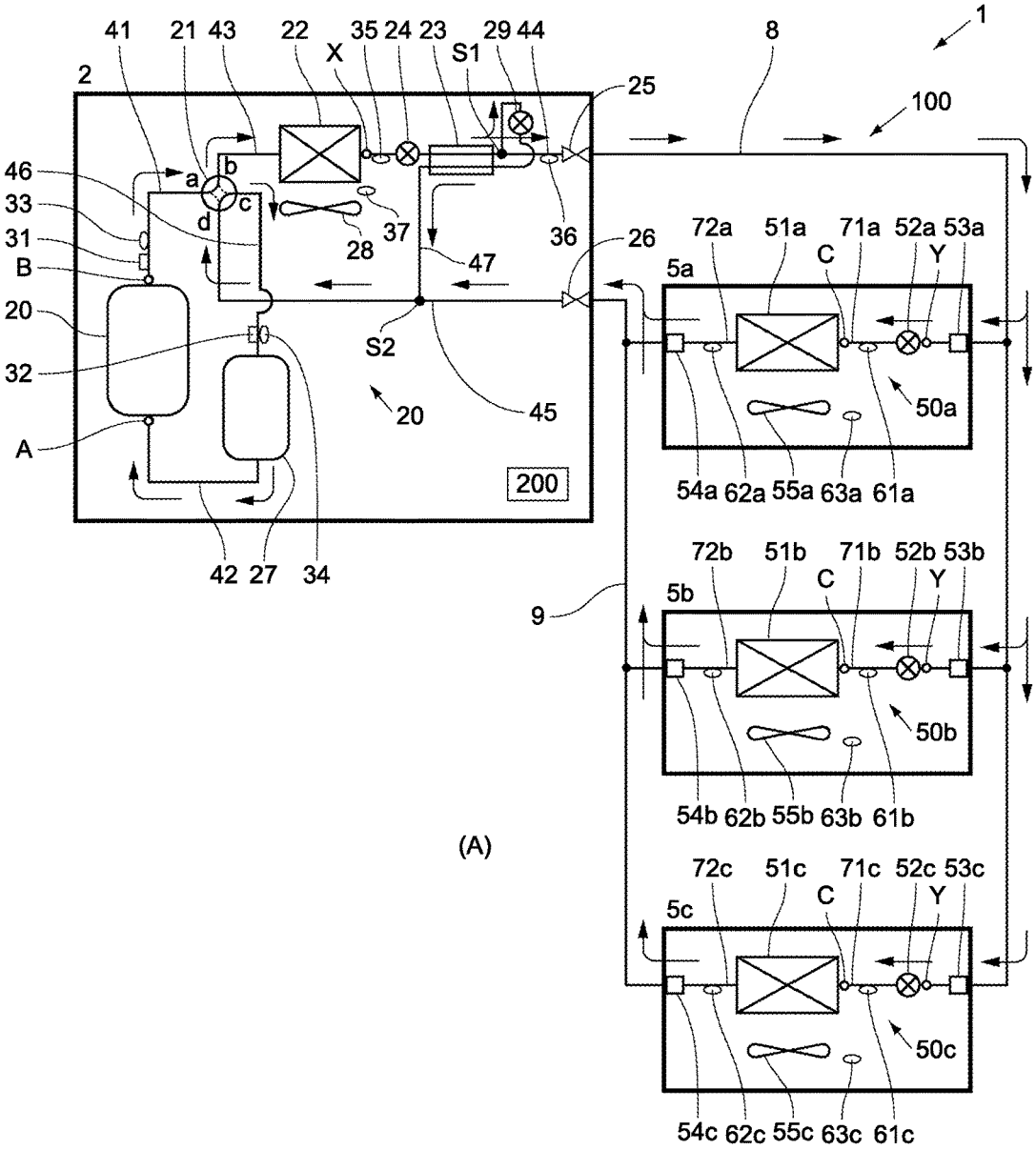
FIG. 1 is an explanatory view of an air conditioner according to an embodiment of the present invention, (A) is a refrigerant circuit diagram, and (B) is a block diagram of an outdoor unit control means.
Figure 1:
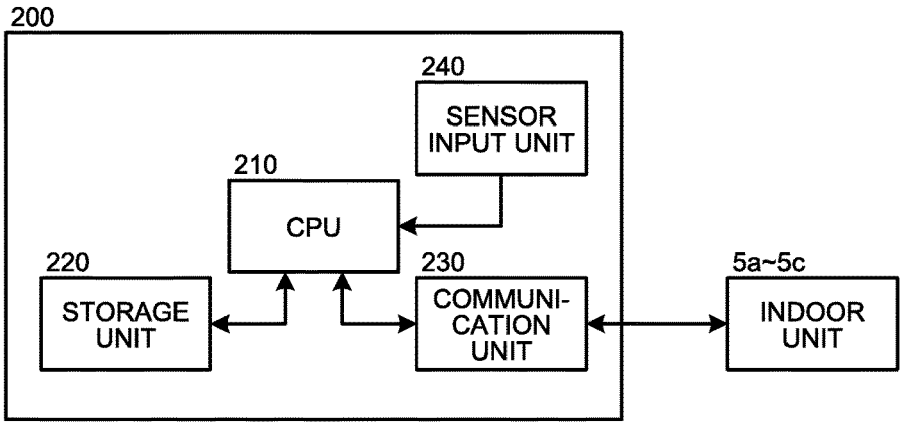

Hereinafter, an embodiment of the present invention will be described in detail with reference to the accompanying drawings. As the embodiment, a description will be given by exemplifying an air conditioner in which three indoor units are connected in parallel to one outdoor unit and a cooling operation or a heating operation can be performed simultaneously in all the indoor units. Incidentally, the present invention is not limited to the following embodiment, and can be variously modified within a scope not departing from a gist of the present invention.

Embodiment

As illustrated in FIG. 1(A), an air conditioner 1 according to the present embodiment includes one outdoor unit 2, and three indoor units 5*a* to 5*c* connected to the outdoor unit 2 in parallel by a liquid pipe 8 and a gas pipe 9. Specifically, the liquid pipe 8 has one end connected to a closing valve 25 of the outdoor unit 2 and the other ends branching off to be connected to liquid pipe connecting portions 53*a* to 53*c* of the indoor units 5*a* to 5*c*, respectively. In addition, the gas pipe 9 has one end connected to a closing valve 26 of the outdoor unit 2 and the other ends branching off to be connected to gas pipe connecting portions 54*a* to 54*c* of the indoor units 5*a* to 5*c*, respectively. As a result, a refrigerant circuit 100 of the air conditioner 1 is formed.

Incidentally, it is assumed in the air conditioner 1 of the present embodiment that the capacity of the outdoor unit 2 is 14 kW, the capacity of the indoor units 5*a* to 5*c* is all 4.5 kW, an inner diameter of the liquid pipe 8 is 7.5 mm, an inner diameter of the gas pipe is 13.9 mm, and both lengths of the liquid pipe 8 and the gas pipe 9 are 15 m as an example of device information requested at the time of determining the amount of refrigerant to be charged in the refrigerant circuit 100 by a method to be described later.

<Configuration of Outdoor Unit>

First, the outdoor unit 2 will be described. The outdoor unit 2 includes a compressor 20, a four-way valve 21, an outdoor heat exchanger 22, a supercooling heat exchanger 23, an outdoor expansion valve 24, the closing valve 25 to which one end of the liquid pipe 8 is connected, the closing valve 26 to which one end of the gas pipe 9 is connected, an accumulator 27, an outdoor fan 28, and a bypass expansion valve 29. Further, these devices other than the outdoor fan 28 are connected to each other through each refrigerant pipe, which will be described later in detail, to form an outdoor unit refrigerant circuit 20 constituting a part of the refrigerant circuit 100.

The compressor 20 is a variable capacity compressor that can vary the operating capacity by being driven by a motor (not illustrated) whose rotation speed is controlled by an inverter. A refrigerant discharge side of the compressor 20 is connected to a port a of the four-way valve 21 by a discharge pipe 41, which will be described later, and a refrigerant suction side of the compressor 20 is connected to a refrigerant outflow side of the accumulator 27 by a suction pipe 42.

The four-way valve 21 is a valve configured to switch a flowing direction of refrigerant, and includes four ports a, b, c, and d. The port a is connected to the refrigerant discharge side of the compressor 20 by the discharge pipe 41 as described above. The port b is connected to one refrigerant inlet/outlet of the outdoor heat exchanger 22 by a refrigerant pipe 43. The port c is connected to the refrigerant inflow side of the accumulator 27 by a refrigerant pipe 46. Further, the port d is connected to the closing valve 26 by an outdoor unit gas pipe 45.

The outdoor heat exchanger 22 is, for example, a fin-and-tube heat exchanger, and exchanges heat between the refrigerant and outside air taken into the outdoor unit 2 by rotation of the outdoor fan 28 to be described later. As described above, one refrigerant inlet/outlet of the outdoor heat exchanger 22 is connected to the port b of the four-way valve 21 by the refrigerant pipe 43, and the other refrigerant inlet/outlet is connected to the closing valve 25 by the outdoor unit liquid pipe 44.

The outdoor expansion valve 24 is provided in the outdoor unit liquid pipe 44. The outdoor expansion valve 24 is an electronic expansion valve, and the opening degree thereof is fully opened during the cooling operation. In addition, the opening degree thereof is adjusted such that a temperature of refrigerant discharged from the compressor 20 becomes a predetermined target temperature during the heating operation.

The supercooling heat exchanger 23 is arranged between the outdoor expansion valve 24 and the closing valve 25. The supercooling heat exchanger 23 is, for example, a double-pipe heat exchanger, an inner pipe (not illustrated) of the double-pipe heat exchanger is arranged to be a part of a bypass pipe 47, which will be described later, and an outer pipe (not illustrated) is arranged to be a part of the outdoor unit liquid pipe 44. In the supercooling heat exchanger 23, heat is exchanged between low-pressure refrigerant that is decompressed by the bypass expansion valve 29, which will be described later, and flows through the inner pipe and high-pressure refrigerant that flows out of the outdoor heat exchanger 22 and flows through the outer pipe during the cooling operation.

The bypass pipe 47 has one end connected to a connection point S1 between the supercooling heat exchanger 23 and the closing valve 25 in the outdoor unit liquid pipe 44 and the other end connected to a connection point S2 of the outdoor unit gas pipe 45. As described above, the inner pipe (not illustrated) of the supercooling heat exchanger 23 forms a part of the bypass pipe 47, and the bypass expansion valve 29 is provided between the connection point S1 of the bypass pipe 47 on the supercooling heat exchanger 23 side and the inner pipe of the supercooling heat exchanger 23. The bypass expansion valve 29 is an electronic expansion valve, and the opening degree thereof is adjusted during the cooling operation so as to decompress some of refrigerant flowing out of the outdoor heat exchanger 22 and to adjust the amount of refrigerant flowing through the supercooling heat exchanger 23 to the outdoor unit gas pipe 45. Incidentally, the bypass expansion valve 29 is fully closed during the heating operation.

As described above, the accumulator 27 is connected to the port c of the four-way valve 21 by the refrigerant pipe 46 on the refrigerant inflow side, and is connected to the refrigerant suction side of the compressor 20 by the suction pipe 42 on the refrigerant outflow side. The accumulator 27 separates the refrigerant that has flowed into the accumulator 27 from the refrigerant pipe 46 into gas refrigerant and liquid refrigerant, and causes the compressor 20 to suck only the gas refrigerant.

The outdoor fan 28 is formed using a resin material and is arranged in the vicinity of the outdoor heat exchanger 22. The outdoor fan 28 takes in outside air from an air inlet (not illustrated) into the outdoor unit 2 by being rotated by a fan motor (not illustrated), and discharges the outside air that has been subjected to heat exchange with the refrigerant in the outdoor heat exchanger 22 from an air outlet (not illustrated) to the outside of the outdoor unit 2.

In addition to the configuration described above, the outdoor unit 2 is provided with various sensors. As illustrated in FIG. 1(A), the discharge pipe 41 is provided with a discharge pressure sensor 31 that detects a discharge pressure, which is a pressure of refrigerant discharged from the compressor 20, and a discharge temperature sensor 33 that detects a discharge temperature which is a temperature of the refrigerant discharged from the compressor 20. A suction pressure sensor 32 that detects a pressure of refrigerant sucked into the compressor 20 and a suction temperature sensor 34 that detects a temperature of the refrigerant sucked into the compressor 20 are provided in the vicinity of a refrigerant inlet of the accumulator 27 in the refrigerant pipe 46.

A first liquid temperature sensor 35 that detects a temperature of refrigerant flowing out of the outdoor heat exchanger 22 during the cooling operation is provided between the outdoor heat exchanger 22 and the outdoor expansion valve 24 in the outdoor unit liquid pipe 44. A second liquid temperature sensor 36 that detects a temperature of the refrigerant flowing out of the supercooling heat exchanger 23 during the cooling operation, that is, flowing into the indoor units 5*a* to 5*c*, which will be described later, is provided between the supercooling heat exchanger 23 and the closing valve 25 in the outdoor unit liquid pipe 44. Further, an outside air temperature sensor 37 that detects a temperature of outside air flowing into the outdoor unit 2, that is, the outside air temperature is provided in the vicinity of the air inlet (not illustrated) of the outdoor unit 2.

In addition, the outdoor unit 2 includes an outdoor unit control means 200. The outdoor unit control means 200 is mounted on a control board stored in an electrical component box (not illustrated) of the outdoor unit 2. As illustrated in FIG. 1(B), the outdoor unit control means 200 includes a CPU 210, a storage unit 220, a communication unit 230, and a sensor input unit 240.

The storage unit 220 is configured using a ROM or a RAM, and stores a control program of the outdoor unit 2, detection values corresponding to detection signals from various sensors, control states of the compressor 20 and the outdoor fan 28, and the like. The communication unit 230 is an interface that performs communication with the indoor units 5*a* to 5*c*. The sensor input unit 240 takes detection results from various sensors of the outdoor unit 2 and outputs the results to the CPU 210.

The CPU 210 acquires the detection result of each sensor of the outdoor unit 2 described above via the sensor input unit 240. In addition, the CPU 210 acquires control signals transmitted from the indoor units 5*a* to 5*c* via the communication unit 230. The CPU 210 performs drive control of the compressor 20 and the outdoor fan 28 based on the acquired detection results and control signals. In addition, the CPU 210 performs switching control of the four-way valve 21 based on the acquired detection results and control signals. Furthermore, the CPU 210 adjusts the opening degree of the outdoor expansion valve 24 based on the acquired detection results and control signals.

<Configuration of Indoor Unit>

Next, the three indoor units 5*a* to 5*c* will be described. The three indoor units 5*a* to 5*c* include: indoor heat exchangers 51*a* to 51*c*; indoor expansion valves 52*a* to 52*c*; the liquid pipe connecting portions 53*a* to 53*c* to which the other ends of branches of the liquid pipe 8 are connected; the gas pipe connecting portions 54*a* to 54*c* to which the other ends of branches of the gas pipe 9 are connected; and indoor fans 55*a* to 55*c*. Further, these devices other than the indoor fans 55*a* to 55*c* are connected to each other through each refrigerant pipe, which will be described later in detail, to form indoor unit refrigerant circuits 50*a* to 50*c* each constituting a part of the refrigerant circuit 100.

Incidentally, the configurations of the indoor units 5*a* to 5*c* are all the same, and thus, only the configuration of the indoor unit 5*a* will be described in the following description, and descriptions regarding the other indoor units 5*b* and 5*c* will be omitted. In addition, those whose ends of numbers, given to the respective configurations in the indoor unit 5*a*, have changed from a to b or c in FIG. 1 represent the respective configurations in the indoor unit 5*b* or 5*c* corresponding to the respective configurations in the indoor unit 5*a*.

The indoor heat exchanger 51*a* exchanges heat between refrigerant and indoor air taken into the inside of the indoor unit 5*a* from the air inlet (not illustrated) by the rotation of the indoor fan 55*a*, which will be described later, and has one refrigerant inlet/outlet connected to the liquid pipe connecting portion 53*a* by an indoor unit liquid pipe 71*a*, and the other refrigerant inlet/outlet connected to the gas pipe connecting portion 54*a* by an indoor unit gas pipe 72*a*. The indoor heat exchanger 51*a* functions as an evaporator when the indoor unit 5*a* performs the cooling operation, and functions as a condenser when the indoor unit 5*a* performs the heating operation. Incidentally, the liquid pipe 8 is connected to the liquid pipe connecting portion 53*a* by welding, a flare nut, or the like, and the gas pipe 9 is connected to the gas pipe connecting portion 54*a* by welding, a flare nut, or the like.

The indoor expansion valve 52*a* is provided in the indoor unit liquid pipe 71*a*. The indoor expansion valve 52*a* is an electronic expansion valve, and the opening degree thereof is adjusted such that a refrigerant superheating degree at the refrigerant outlet (on the gas pipe connecting portion 54*a* side) of the indoor heat exchanger 51*a* becomes a target refrigerant superheating degree when the indoor heat exchanger 51*a* functions as the evaporator, that is, when the indoor unit 5*a* performs the cooling operation. In addition, the opening degree of the indoor expansion valve 52*a* is adjusted such that a refrigerant supercooling degree at the refrigerant outlet (on the liquid pipe connecting portion 53*a* side) of the indoor heat exchanger 51*a* becomes a target refrigerant supercooling degree when the indoor heat exchanger 51*a* functions as the condenser, that is, when the indoor unit 5*a* performs the heating operation. Here, the target refrigerant superheating degree and the target refrigerant supercooling degree are values for exhibition of sufficient heating capacity or cooling capacity in the indoor unit 5*a*.

The indoor fan 55*a* is formed using a resin material and is arranged in the vicinity of the indoor heat exchanger 51*a*. The indoor fan 55*a* is rotated by the fan motor (not illustrated) to acquire indoor air into the indoor unit 5*a* from the air inlet (not illustrated) and supply the indoor air that has been subjected to heat exchange with the refrigerant in the indoor heat exchanger 51*a* into the room from the air outlet (not illustrated).

In addition to the configuration described above, the indoor unit 5*a* is provided with various sensors. A liquid-side temperature sensor 61*a*, which detects a temperature of refrigerant flowing into the indoor heat exchanger 51*a* or flowing out of the indoor heat exchanger 51*a*, is provided between the indoor heat exchanger 51*a* and the indoor expansion valve 52*a* in the indoor unit liquid pipe 71*a*. The indoor unit gas pipe 72*a* is provided with a gas-side temperature sensor 62*a* which detects a temperature of refrigerant flowing out of the indoor heat exchanger 51*a* or flowing into the indoor heat exchanger 51*a*. An indoor temperature sensor 63*a*, which detects a temperature of indoor air flowing into the indoor unit 5*a*, that is, an indoor temperature, is provided in the vicinity of the air inlet (not illustrated) of the indoor unit 5*a*.

In addition, the indoor unit 5*a* is provided with an indoor unit control means although the illustration and detailed description thereof are omitted. The indoor unit control means includes a CPU, a storage unit, a communication unit that communicates with the outdoor unit 2, and a sensor input unit that acquires detection values of the above-described respective temperature sensors, which is similar to the outdoor unit control means 200.

<Operation of Air Conditioner>

Next, refrigerant flow and operations of the respective units in the refrigerant circuit 100 during an air conditioning operation of the air conditioner 1 according to the present embodiment will be described with reference to FIG. 1(A). Incidentally, a case where the indoor units 5*a* to 5*c* perform the cooling operation will be described in the following description, and the detailed description regarding a case where the heating operation is performed will be omitted. In addition, each arrow in FIG. 1(A) indicates the flow of refrigerant during the cooling operation.

As illustrated in FIG. 1(A), when the indoor units 5*a* to 5*c* perform the cooling operation, the CPU 210 of the outdoor unit control means 200 switches the four-way valve 21 to a state indicated by a solid line, that is, the state in which the port a and the port b of the four-way valve 21 communicate with each other and the port c and the port d communicate with each other. As a result, the refrigerant circuit 100 is set to a cooling cycle in which the outdoor heat exchanger 22 functions as the condenser and the indoor heat exchangers 51*a* to 51*c* function as the evaporators.

The high-pressure refrigerant discharged from the compressor 20 flows through the discharge pipe 41 to flow into the four-way valve 21, and flows from the four-way valve 21 into the outdoor heat exchanger 22 through the refrigerant pipe 43. The refrigerant flowing into the outdoor heat exchanger 22 is condensed by exchanging heat with the outside air taken into the outdoor unit 2 by the rotation of the outdoor fan 28. The refrigerant flowing out of the outdoor heat exchanger 22 into the outdoor unit liquid pipe 44 passes through the outdoor expansion valve 24 whose opening degree is fully opened, and flows into (the outer pipe (not illustrated) of) the supercooling heat exchanger 23. Some of the refrigerant flowing out of the supercooling heat exchanger 23 into the outdoor unit liquid pipe 44 is diverted to the bypass pipe 47, and the remaining refrigerant flows into the liquid pipe 8 through the closing valve 25.

In the supercooling heat exchanger 23, the refrigerant that has flowed into the outer pipe (not illustrated) from the outdoor unit liquid pipe 44 exchanges heat with the refrigerant that has been depressurized by the bypass expansion valve 29 and flowed into the inner pipe (not illustrated) from the bypass pipe 47. The refrigerant that has flowed out of the supercooling heat exchanger 23 into the bypass pipe 47 flows to the outdoor unit gas pipe 45. The refrigerant that has flowed out of the supercooling heat exchanger 23 into the outdoor unit liquid pipe 44 flows into the liquid pipe 8 through the closing valve 25 as described above. Incidentally, an opening degree of the bypass expansion valve 29 is adjusted such that a superheating degree of the refrigerant that has flowed out of the supercooling heat exchanger 23 into the bypass pipe 47 becomes a predetermined value (for example, 3 deg).

The refrigerant flowing through the liquid pipe 8 flows into the indoor units 5*a* to 5*c* through the liquid pipe connecting portions 53*a* to 53*c*. The refrigerant that has flowed into the indoor units 5*a* to 5*c* flows through the indoor unit liquid pipes 71*a* to 71*c*, is decompressed by the indoor expansion valves 52*a* to 52*c*, and flows into the indoor heat exchangers 51*a* to 51*c*. The refrigerant that has flowed into the indoor heat exchangers 51*a* to 51*c* evaporates by exchanging heat with the indoor air taken into the indoor units 5*a* to 5*c* by the rotation of the indoor fans 55*a* to 55*c*. In this manner, the indoor heat exchangers 51*a* to 51*c* function as the evaporators, and the indoor air that has been cooled by exchanging heat with the refrigerant in the indoor heat exchangers 51*a* to 51*c* is blown into the room from the air outlet (not illustrated), thereby performing cooling inside the room where the indoor units 5*a* to 5*c* are installed.

The refrigerant that has flowed out of the indoor heat exchangers 51*a* to 51*c* flows through the indoor unit gas pipes 72*a* to 72*c*, and flows into the gas pipe 9 through the gas pipe connecting portions 54*a* to 54*c*. The refrigerant flowing through the gas pipe 9 flows into the outdoor unit 2 through the closing valve 26. The refrigerant that has flowed into the outdoor unit 2 flows through the outdoor unit gas pipe 45, the four-way valve 21, the refrigerant pipe 46, the accumulator 27, and the suction pipe 42 in this order, and is sucked into the compressor 20 and compressed again.

Incidentally, when the indoor units 5*a* to 5*c* perform the heating operation, the CPU 210 switches the four-way valve 21 to a state indicated by a broken line, that is, the state in which the port a and the port d of the four-way valve 21 communicate with each other and the port b and the port c communicate with each other. As a result, the refrigerant circuit 100 is set to a heating cycle in which the outdoor heat exchanger 22 functions as an evaporator and the indoor heat exchangers 51*a* to 51*c* function as condensers.

<Determination of Refrigerant Charge Amount>

Next, a method for determining the amount of refrigerant to be charged in the refrigerant circuit 100 in the air conditioner 1 according to the present embodiment will be described with reference to FIGS. 1 and 2. In the present embodiment, the refrigerant circuit 100 is charged with the amount of refrigerant smaller than an upper-limit charge amount which is an upper limit value of the charge amount to be described later and larger than a lower-limit charge amount which is a lower limit value of the charge amount.

Figure 2:
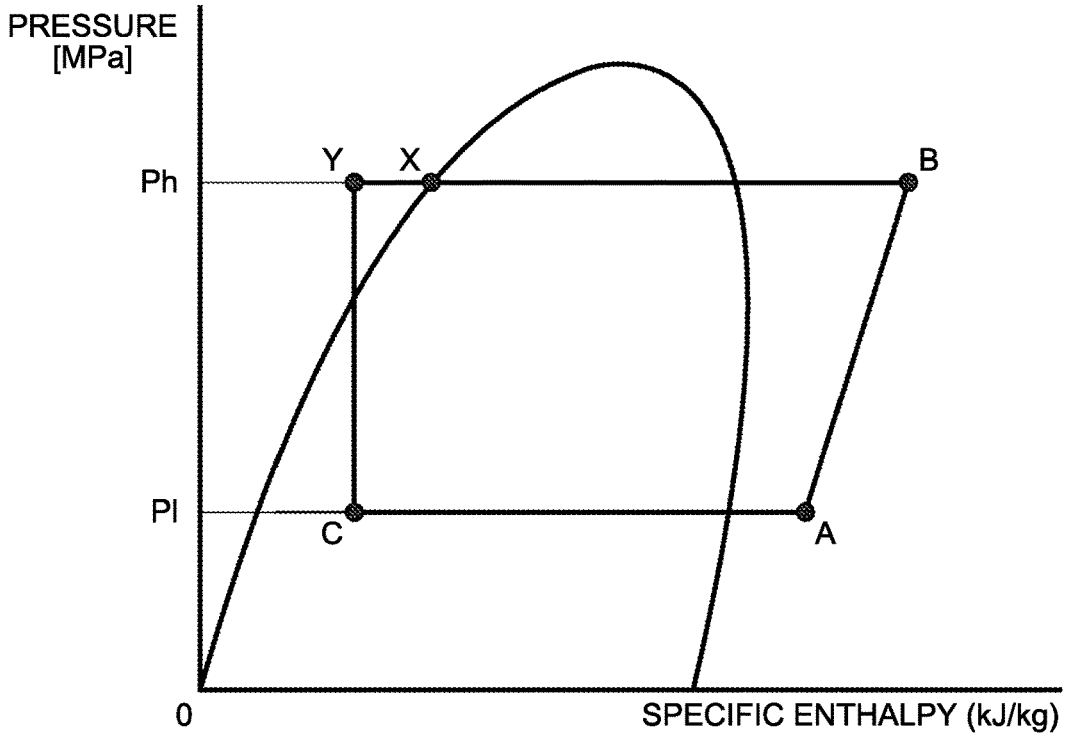
FIG. 2 is a Mollier diagram representing a refrigeration cycle during a cooling operation according to an embodiment of the present invention, (A) illustrates a case of charging an upper-limit charge amount of refrigerant in a refrigerant circuit, and (B) illustrates a case of charging a lower-limit charge amount of refrigerant in the refrigerant circuit.
Figure 2:
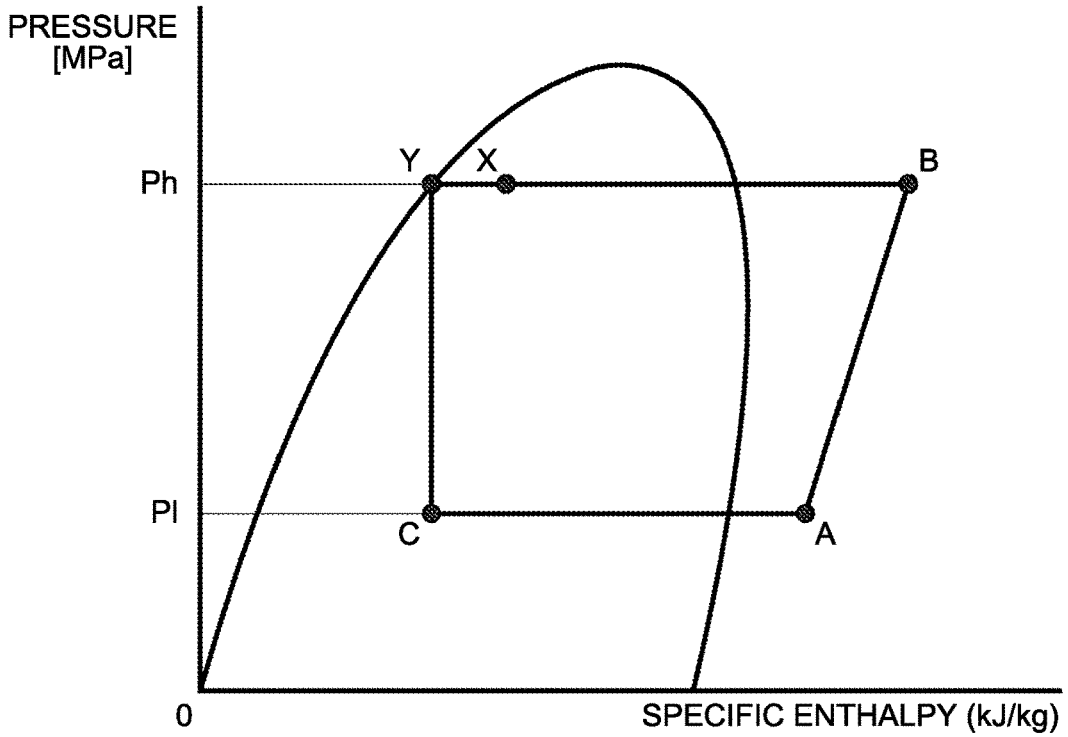

FIG. 2 is a Mollier diagram illustrating a refrigeration cycle during the cooling operation of the air conditioner 1, the vertical axis represents the pressure of refrigerant (unit: MPa), and the horizontal axis represents the specific enthalpy (unit: kJ/kg). A point A in FIG. 2 corresponds to a point A in FIG. 1, that is, a state of refrigerant on the refrigerant suction side of the compressor 20. A point B in FIG. 2 corresponds to a point B in FIG. 1, that is, a state of refrigerant on the refrigerant discharge side of the compressor 20. A point C in FIG. 2 corresponds to a point C in FIG. 1, that is, a state of refrigerant on the refrigerant inflow side of the indoor heat exchangers 51*a* to 51*c* of the indoor units 5*a* to 5*c*. A point X in FIG. 2 corresponds to a point X in FIG. 1, that is, a state of refrigerant on the refrigerant outlet side of the outdoor heat exchanger 22. A point Y in FIG. 2 corresponds to a point Y in FIG. 1, that is, a state of refrigerant on the refrigerant inflow side of the indoor expansion valves 52*a* to 52*c* of the indoor units 5*a* to 5*c*.

<Regarding Upper-Limit Charge Amount>

First, the upper-limit charge amount which is the upper limit of refrigerant to be charged in the refrigerant circuit 100 will be described. The upper-limit charge amount is a refrigerant amount with which refrigerant at the point X illustrated in FIG. 1, that is, on the refrigerant outlet side of the outdoor heat exchanger 22 that functions as the condenser has a refrigerant supercooling degree=0 deg and a refrigerant quality=0 when the air conditioner 1 performs the cooling operation under rated conditions, that is, conditions with outdoor dry-bulb temperature: 35° C./wet-bulb temperature: 24° C. and indoor dry-bulb temperature: 27° C./wet-bulb temperature: 19° C.

In other words, the upper-limit charge amount is the charge amount with which the refrigerant is fully condensed on the refrigerant outlet side of the outdoor heat exchanger 22 (the entire gas refrigerant flowing into the outdoor heat exchanger 22 becomes liquid refrigerant) during the cooling operation under the rated conditions. Further, a refrigeration cycle when the outdoor unit 2 is charged in advance with the upper-limit charge amount of refrigerant and the cooling operation is performed is the Mollier diagram illustrated in FIG. 2(A).

Specifically, low-temperature refrigerant having a pressure P1 sucked into the compressor 20 (the state at the point A in FIG. 2(A)) is compressed by the compressor 20 to become high-temperature refrigerant having a pressure Ph (>P1) (the state at the point B in FIG. 2(A)), and is discharged from the compressor 20. The refrigerant discharged from the compressor 20 flows into the outdoor heat exchanger 22 through the four-way valve 21, exchanges heat with outside air in the outdoor heat exchanger 22 to be condensed, and becomes low-temperature refrigerant (the state at the point X in FIG. 2(A)) having the pressure Ph, a refrigerant supercooling degree=0 deg, and a refrigerant quality=0 on the refrigerant outlet side of the outdoor heat exchanger 22.

The refrigerant that has flowed out of the outdoor heat exchanger 22 passes through the outdoor expansion valve 24 that is fully opened, flows into the supercooling heat exchanger 23, is cooled by the supercooling heat exchanger 23 to be low-temperature refrigerant, which is the refrigerant having the pressure Ph and a refrigerant supercooling degree>0 deg (at the point Y in FIG. 2(A)), and flows out of the supercooling heat exchanger 23. The refrigerant which has flowed out of the supercooling heat exchanger 23 flows out of the outdoor unit 2 through the closing valve 25, flows through the liquid pipe 8, and branches off to the indoor units 5*a* to 5*c*.

The refrigerant that has flowed into the indoor units 5*a* to 5*c* through the liquid pipe connecting portions 53*a* to 53*c* is decompressed to have the pressure P1 by the indoor expansion valves 52*a* to 52*c* (the state at the point C in FIG. 2(A)) and flows into the indoor heat exchangers 51*a* to 51*c*, exchanges heat with indoor air to evaporate and become superheated steam (the state at the point A in FIG. 2(A)), and flows out of the indoor heat exchangers 51*a* to 51*c*. Further, the refrigerant that has flowed out of the indoor heat exchangers 51*a* to 51*c* flows into the outdoor unit 2 through the gas pipe connecting portions 54*a* to 54*c*, the gas pipe 9, and the closing valve 26, and is sucked into the compressor 20 again through the four-way valve 21 and the accumulator 27.

A condensation pressure (corresponding to the pressure Ph in FIG. 2(A)) in the outdoor heat exchanger 22 when the outdoor unit 2 is charged in advance with the amount of refrigerant larger than the upper-limit charge amount described above and the cooling operation is performed under the rated conditions is higher than the pressure Ph when the upper-limit charge amount is charged in advance. As a result, a temperature difference between a condensation temperature and an outside air temperature increases, the entire refrigerant is condensed at a point closer to the inner side of the outdoor heat exchanger 22 from the refrigerant outlet side of the outdoor heat exchanger 22, and a portion from the point to the refrigerant outlet side is filled with liquid refrigerant.

That is, the liquid refrigerant filling the portion from the refrigerant outlet side of the outdoor heat exchanger 22 to the point on the inner side of the outdoor heat exchanger 22 remains in the outdoor heat exchanger 22. Meanwhile, if the refrigerant circuit 100 is charged with the upper-limit charge amount of refrigerant, the refrigerant on the refrigerant outlet side of the outdoor heat exchanger 22 has the refrigerant supercooling degree=0 deg and the refrigerant quality=0, and a specific enthalpy difference necessary for exhibition of the cooling capacity requested by the indoor units 5*a* to 5*c* can be secured.

Accordingly, when the refrigerant circuit 100 is charged with the amount of refrigerant equal to or larger than the upper-limit charge amount, it is considered that the refrigerant remaining inside the outdoor heat exchanger 22 is excessive. In the air conditioner 1 of the present embodiment, the upper-limit charge amount is defined as the upper limit value of the amount of refrigerant to be charged in the refrigerant circuit 100, and thus, it is possible to prevent the excessive amount of refrigerant from being charged while ensuring the specific enthalpy difference necessary for exhibition of the cooling capacity requested by the indoor units 5*a* to 5*c*.

<Regarding Lower-Limit Charge Amount>

Next, the lower-limit charge amount which is the lower limit of refrigerant to be charged in the refrigerant circuit 100 will be described. The lower-limit charge amount is a refrigerant amount with which the refrigerant at the point Y illustrated in FIG. 1, that is, on the refrigerant inlet side of the indoor expansion valves 52*a* to 52*c* of the indoor units 5*a* to 5*c* has a refrigerant supercooling degree=0 deg and a refrigerant quality=0 when the air conditioner 1 performs the cooling operation under overload conditions, for example, upper-limit temperatures of each dry-bulb temperature/wet-bulb temperature outside and inside the room where the air conditioner 1 can perform the cooling operation (for example, outdoor dry-bulb temperature: 43° C./wet-bulb temperature: 26° C., and indoor dry-bulb temperature: 32° C./wet-bulb temperature: 23° C.)

That is, the lower-limit charge amount is the charge amount of refrigerant with which the refrigerant is fully condensed on the refrigerant inlet side of the indoor expansion valves 52*a* to 52*c* (the refrigerant passing through the indoor expansion valves 52*a* to 52*c* becomes liquid refrigerant) when the air conditioner 1 performs the cooling operation under an environment where each outdoor/indoor dry-bulb temperature/wet-bulb temperature is higher than those of the rated conditions, that is, under an environment where the refrigerant is hardly condensed in the outdoor heat exchanger 22 that functions as the condenser as compared to the rated conditions. Further, a refrigeration cycle when the outdoor unit 2 is charged in advance with the lower-limit charge amount of refrigerant and the cooling operation is performed is the Mollier diagram illustrated in FIG. 2(B).

Specifically, refrigerant having a low temperature and a pressure P1 sucked into the compressor 20 (the state at the point A in FIG. 2(B)) is compressed by the compressor 20 to become high-temperature refrigerant having a pressure Ph (>P1) (the state at the point B in FIG. 2(B)), and is discharged from the compressor 20. The refrigerant that has been discharged from the compressor 20 flows into the outdoor heat exchanger 22 through the four-way valve 21, exchanges heat with outside air in the outdoor heat exchanger 22 to be condensed, and becomes low-temperature refrigerant having the pressure Ph on the refrigerant outlet side of the outdoor heat exchanger 22, but the refrigerant at this time has not been fully condensed and is still in a gas-liquid two-phase state (the state at the point X in FIG. 2(B)).

The refrigerant in the gas-liquid two-phase state that has flowed out of the outdoor heat exchanger 22 passes through the outdoor expansion valve 24 that is fully opened and flows into the supercooling heat exchanger 23, is cooled by the supercooling heat exchanger 23 to become low-temperature refrigerant (the state at the point Y in FIG. 2(B)) having the pressure Ph, a refrigerant supercooling degree=0 deg, and a refrigerant quality=0, and flows out of the supercooling heat exchanger 23. The refrigerant which has flowed out of the supercooling heat exchanger 23 flows out of the outdoor unit 2 through the closing valve 25, flows through the liquid pipe 8, and branches off to the indoor units 5*a* to 5*c*. Incidentally, the subsequent courses (the point Y→the point C→the point A) are the same as those described with reference to FIG. 2(A) when the upper-limit charge amount is described, and thus, the description thereof will be omitted.

When the outdoor unit 2 is charged in advance with the amount of refrigerant smaller than the lower-limit charge amount described above, a condensation pressure in the outdoor heat exchanger 22 (corresponding to the pressure Ph in FIG. 2(B)) is lower than the pressure Ph at the time when the lower-limit charge amount is charged in advance. In such a case, a temperature difference between a condensation temperature and an outside air temperature decreases so that the refrigerant is not fully condensed even if the refrigerant is cooled by the outdoor heat exchanger 22, and there is a concern that the refrigerant in the gas-liquid two-phase state may flow through the indoor expansion valves 52*a* to 52*c* of the indoor units 5*a* to 5*c* even if the refrigerant is further cooled by the supercooling heat exchanger 23.

In the state as described above, there is a concern that refrigerant sound is generated when the refrigerant in the gas-liquid two-phase state passes through the indoor expansion valves 52*a* to 52*c*. In addition, opening degrees of the indoor expansion valves 52*a* to 52*c* are originally adjusted assuming that liquid refrigerant passes through the indoor expansion valves 52*a* to 52*c*, and thus, the controllability of the indoor expansion valves 52*a* to 52*c* deteriorates if the refrigerant passing through the indoor expansion valves 52*a* to 52*c* is in the gas-liquid two-phase state.

In consideration of the above description, the lower-limit charge amount is defined as the refrigerant amount with which the refrigerant on the refrigerant inlet side of the indoor expansion valves 52*a* to 52*c* has the refrigerant supercooling degree=0 deg and the refrigerant quality=0 under the overload conditions described above in the present embodiment. If the outdoor unit 2 is charged in advance with the amount of refrigerant equal to or larger than the lower limit amount, it is possible to suppress the generation of refrigerant sound and the deterioration of controllability in the indoor expansion valves 52*a* to 52*c*.

<Calculation Methods of Lower-Limit Charge Amount and Upper-Limit Charge Amount>

Next, calculation methods of the lower-limit charge amount and the upper-limit charge amount will be described.

<Calculation Method of Lower-Limit Charge Amount>

First, the lower-limit charge amount is calculated using the following Formulas 1 to 4. These Formulas 1 to 4 are obtained by conducting a test or the like in advance.

$$\text{Lower-limit charge amount}=(\rho c1\times Vc+\rho e1\times Ve+\alpha 1\times Vo)\times 10-3 \quad \text{Formula 1}$$

$$\rho c1=a1\times\beta c \quad \text{Formula 2}$$

$$\rho e1=b1\times\beta e \quad \text{Formula 3}$$

$$\alpha 1=c1\times\beta l \quad \text{Formula 4}$$

ρc1: An average refrigerant density inside the outdoor heat exchanger 22 under overload conditions ρe1: An average refrigerant density in the indoor heat exchangers 51*a* to 51*c* under overload conditions βl: A factor obtained by associating an average refrigerant density distributed in refrigerant pipes of refrigerant circuit 100 excluding the outdoor heat exchanger 22 and the indoor heat exchangers 51*a* to 51*c* under overload conditions and a volume of the refrigerant circuit 100 excluding the outdoor heat exchanger 22 and the indoor heat exchangers 51*a* to 51*c* with an in-pipe volume of the outdoor heat exchanger 22

Vc: An in-pipe volume of a heat exchanger functioning as a condenser

Ve: An in-pipe volume of a heat exchanger functioning as an evaporator

Vo: An in-pipe volume of the outdoor heat exchanger 22

βc: A ratio of an average value of refrigerant densities of reference refrigerant with a quality of 0 to 1.0 to an average value of refrigerant densities of use refrigerant with a quality of 0 to 1.0 at a condensation temperature of 50° C.

βe: A ratio of an average value of refrigerant densities of reference refrigerant with a quality of 0.3 to 1.0 to an average value of refrigerant densities of use refrigerant with a quality of 0.3 to 1.0 at an evaporation temperature of 10° C.

βl: A ratio of a saturated liquid refrigerant density of reference refrigerant at 50° C. to a saturated liquid refrigerant density of use refrigerant used at 50° C.

a1, b1, c1: Factors obtained by the test.

Among the respective values in Formulas 1 to 4 described above, the in-pipe volume Vc of the heat exchanger that functions as the condenser, the in-pipe volume Ve of the heat exchanger that functions as the evaporator, and the in-pipe volume Vo of the outdoor heat exchanger 22 are volumes of paths (not illustrated) provided in each of the heat exchangers, and are known at the time of installation of the air conditioner 1 (since the outdoor units and indoor units are selected before the installation according to a size of buildings and the number of rooms where the air conditioner 1 is installed). Therefore, all these volumes Vc, Ve, and Vo are constants.

For example, when the air conditioner 1 of the present embodiment performs the cooling operation, the in-pipe volume Vc of the heat exchanger that functions as the condenser is the in-pipe volume of the outdoor heat exchanger 22, and the in-pipe volume Ve of the heat exchanger functioning as the evaporator is the total in-pipe volume of the indoor heat exchangers 51*a* to 51*c*.

In addition, βc, βe, and βl are the ratios of the refrigerant densities of the reference refrigerant and the use refrigerant under the above-described conditions, respectively. Here, the reference refrigerant is arbitrarily defined refrigerant, for example, R410A refrigerant that is generally used in an air conditioner. In addition, the used refrigerant is refrigerant that is actually charged in the refrigerant circuit and used in the air conditioner, for example, R32 refrigerant. Therefore, if the reference refrigerant and the use refrigerant are the same, βc, βe, and βl are all 1. In addition, if the reference refrigerant is R410A refrigerant and the use refrigerant is R32 refrigerant, for example, βc=0.80, βe=0.73, and βl=0.93.

In this manner, if βc, βe, and βl are set as the ratios of the refrigerant densities of the reference refrigerant and the use refrigerant, Formula 1 can be used without being changed even when the refrigerant to be charged in the refrigerant circuit 100 of the air conditioner 1 is changed. Incidentally, the "condensation temperature of 50° C.", which is the condition at the time of determining βc, is obtained by converting a general condensation pressure during the cooling operation of the air conditioner 1 into a temperature, and further, the "evaporation temperature of 10° C.", which is the condition at the time of determining βe, is obtained by converting a general evaporation pressure during the cooling operation of the air conditioner 1 into a temperature. In addition, the "refrigerant quality of 0.3", which is the condition at the time of calculating the refrigerant density used to determine βe, is the quality of refrigerant at the point C illustrated in FIG. 2(A).

Meanwhile, a1, b1, and c1 are factors determined by conducting the test to be described later.

The first term "ρc1×Vc", the second term "ρe1×Ve", and the third term "α1×Vo" in Formula 1, respectively, represent a refrigerant amount present in the outdoor heat exchanger 22 functioning as the condenser (the "refrigerant amount" herein represents the mass of refrigerant present in the heat exchanger, which will be simply described as the "refrigerant amount" hereinafter unless necessary), a refrigerant amount present in the indoor heat exchangers 51*a* to 51*c* functioning as the evaporators, and a refrigerant amount present in the refrigerant circuit 100 excluding the outdoor heat exchanger 22 and the indoor heat exchangers 51*a* to 51*c*, when the refrigerant supercooling degree on the refrigerant outlet side of the supercooling heat exchanger 23 is 0 deg and the refrigerant quality is 0 during the cooling operation under the overload conditions.

In addition, "α1" in the third term "α1×Vo" in Formula 1 is specifically a value obtained by multiplying an average density of refrigerant distributed in the refrigerant circuit 100 excluding the outdoor heat exchanger 22 and the indoor heat exchangers 51*a* to 51*c* under the overload conditions by a ratio of a volume of the refrigerant circuit 100 excluding the outdoor heat exchanger 22 and the indoor heat exchangers 51*a* to 51*c* to an in-pipe volume of the outdoor heat exchanger 22, obtained by dividing the volume of the refrigerant circuit 100 excluding the outdoor heat exchanger 22 and the indoor heat exchangers 51*a* to 51*c* by the in-pipe volume of the outdoor heat exchanger 22. Here, the volume of the refrigerant circuit 100 is a total value of volumes of refrigerant pipes and devices through which the refrigerant flows in the refrigerant circuit 100 other than the outdoor heat exchanger 22 and the indoor heat exchangers 51*a* to 51*c*.

It is originally requested to calculate and sum the amount of refrigerant present in all portions of the refrigerant circuit 100 except for the above-described heat exchangers in order to calculate the refrigerant amount present in the refrigerant circuit 100 excluding the outdoor heat exchanger 22 and the indoor heat exchangers 51*a* to 51*c*. Specifically, values each of which is obtained by multiplying a volume of a portion excluding each heat exchanger of the refrigerant circuit 100 by a density of refrigerant present in the portion are summed to calculate the refrigerant amount present in all the portions of the refrigerant circuit 100 excluding the above-described respective heat exchangers. However, the above volume of the portion excluding each heat exchanger of the refrigerant circuit 100 has various values depending on the requested capacity, and further, a state of remaining refrigerant is different between the inside of the heat exchanger that functions as the condenser or the evaporator and the portion of the refrigerant circuit 100 excluding each heat exchanger. Therefore, a lot of labor is requested to calculate, for each air conditioner, the refrigerant amount present in all the portions of the refrigerant circuit 100 excluding the above-described respective heat exchangers.

Therefore, in the present embodiment, attention is paid to a fact that there is a correlation between the volume of the portion excluding each heat exchanger of the refrigerant circuit 100 and the in-pipe volume of the outdoor heat exchanger 22 provided in the outdoor unit 2, that is, the fact that the in-pipe volume of the outdoor heat exchanger pipe increases in the air conditioner that requests a large capacity, and accordingly, the volume of the portion excluding each heat exchanger of the refrigerant circuit also increases, and the ratio of the volume of the refrigerant circuit 100 excluding the outdoor heat exchanger 22 and the indoor heat exchangers 51*a* to 51*c* to the in-pipe volume of the outdoor heat exchanger 22, obtained by dividing the volume of the refrigerant circuit 100 excluding the outdoor heat exchanger 22 and the indoor heat exchangers 51*a* to 51*c* by the in-pipe volume of the outdoor heat exchanger 22, is multiplied by the average density of the refrigerant distributed in the refrigerant circuit 100 excluding the outdoor heat exchanger 22 and the indoor heat exchangers 51*a* to 51*c* to calculate the refrigerant amount present in the portions of the refrigerant circuit 100 excluding the outdoor heat exchanger 22 and the indoor heat exchangers 51*a* to 51*c* under the overload conditions.

Next, a method for determining the factors a1, b1, and c1 used in Formulas 2 to 4 will be described. First, the refrigerant circuit 100 of the air conditioner 1 is charged with a predetermined amount of refrigerant (the amount with which the cooling operation can be started). Regarding the charging of refrigerant in the refrigerant circuit 100, the charging is started by connecting a refrigerant cylinder to a charging port (not illustrated) of the refrigerant circuit 100, and the charging is temporarily stopped when the refrigerant cylinder is placed on a weighing scale or the like and the weight of the refrigerant cylinder decreases by a weight corresponding to the predetermined amount of refrigerant. Next, the installation environment of the air conditioner 1 is set to the overload conditions described above (the outdoor dry-bulb temperature: 43° C./wet-bulb temperature 26° C. and the indoor dry-bulb temperature: 32° C./wet-bulb temperature: 23° C.), and the refrigerant circuit 100 is switched to the cooling cycle to start the cooling operation.

When the cooling operation is started and the pressure of refrigerant in the refrigerant circuit 100 is stabilized, the charging of refrigerant is resumed, and a refrigerant supercooling degree and a refrigerant quality on the refrigerant outlet side of the supercooling heat exchanger 23, that is, on the refrigerant inflow side (at the point Y in FIG. 1(A)) of the indoor expansion valves 52*a* to 52*c* are confirmed every predetermined time (for example, every 30 seconds). Incidentally, the refrigerant supercooling degree on the refrigerant outlet side of the supercooling heat exchanger 23 is obtained by subtracting a refrigerant temperature detected by the second liquid temperature sensor 36 from a high-pressure saturation temperature obtained using the high pressure (corresponding to the pressure Ph in FIG. 2(B)) detected by the discharge pressure sensor 31. In addition, the refrigerant quality is confirmed by visual observation by inserting, for example, a sight glass into the refrigerant outlet side of the supercooling heat exchanger 23 (refrigerant becomes white and turbid if the refrigerant is in a gas-liquid two-phase state, and becomes transparent if the refrigerant is liquid refrigerant). Incidentally, regarding the above refrigerant supercooling degree, the CPU 210 of the outdoor unit control means 200 may acquire the high pressure detected by the discharge pressure sensor 31 and the refrigerant temperature detected by the second liquid temperature sensor 36 via the sensor input unit 240, and display the refrigerant supercooling degree calculated using the acquired high pressure and refrigerant temperature on a display unit (not illustrated) of the outdoor unit 2.

When the cooling operation is performed while charging the refrigerant described above, each of the outdoor fan 28 of the outdoor unit 2 and the indoor fans 55*a* to 55*c* of the indoor units 5*a* to 5*c* is driven at a predetermined rotation speed. The outdoor expansion valve 24 of the outdoor unit 2 is fully opened. The opening degree of the bypass expansion valve 29 of the outdoor unit 2 is adjusted such that a superheating degree of the refrigerant flowing out of the supercooling heat exchanger 23 into the bypass pipe 47 becomes a predetermined value (for example, 3 deg). Each opening degree of the indoor expansion valves 52*a* to 52*c* of the indoor units 5*a* to 5*c* is adjusted such that a refrigerant superheating degree on the refrigerant outlet side of the indoor heat exchangers 51*a* to 51*c* has a predetermined value (for example, 2 deg).

The charging of refrigerant is progressed while performing the cooling operation as described above, the charging of refrigerant into the refrigerant circuit 100 is stopped if the refrigerant supercooling degree on the refrigerant outlet side of the supercooling heat exchanger 23 becomes 0 deg and the refrigerant quality becomes 0, and the decrease amount of weight of the refrigerant cylinder is set as the amount of charged refrigerant, that is, the lower limit amount.

The above-described steps are performed for a plurality of types in combinations with different numbers and capabilities of indoor units connected to the outdoor unit 2. That is, the lower limit amount in each case is obtained for the plurality of types of combinations of the outdoor unit 2 and indoor units other than the present embodiment. Further, the respective factors of a1, b1, and c1 are determined such that the lower-limit charge amount calculated by Formula 1 for each combination becomes the lower-limit charge amount obtained in the test conducted for each combination. As an example, a1=310, b1=150, and c1=250 in the case of R410A refrigerant. Further, when the respective factors of a1, b1, and c1 are determined, ρc1, ρe1, and α1 can be calculated by Formulas 2 to 4 using these factors and βc, βe, and βl. For example, when the reference refrigerant and the use refrigerant are the same R410A refrigerant, βc=βe=βl=1, and thus, ρc1=310, ρe1=150, and α1=250.

<Calculation Method of Upper-Limit Charge Amount>

Next, the upper-limit charge amount is calculated using the following Formulas 5 to 8. These Formulas 5 to 8 are obtained by conducting a test or the like in advance in the same manner as Formulas 1 to 4 described above.

$$\text{Upper-limit charge amount}=(\rho c2\times Vc+\rho e2\times Ve+\alpha 2\times Vo)\times 10-3 \quad \text{Formula 5}$$

$$\rho c2=a2\times\beta c \quad \text{Formula 6}$$

$$\rho e2=b2\times\beta e \quad \text{Formula 7}$$

$$\alpha 2=c2\times\beta l \quad \text{Formula 8}$$

ρc2: An average refrigerant density inside the outdoor heat exchanger 22 under rated conditions (>ρc1)

ρe2: An average refrigerant density in the indoor heat exchangers 51*a* to 51*c* under rated conditions (>ρe1)

α2: A factor obtained by associating a refrigerant density distributed in refrigerant pipes of refrigerant circuit 100 excluding the outdoor heat exchanger 22 and the indoor heat exchangers 51*a* to 51*c* under rated conditions and a volume of the refrigerant circuit 100 excluding the outdoor heat exchanger 22 and the indoor heat exchangers 51*a* to 51*c* with an in-pipe volume of the outdoor heat exchanger 22 (>α1)

a2, b2, c2: Factors obtained by the test (a2>a1, b2>b1, and c2>c1)

*Vc, Ve, Vo, βc, βe, and βl have the same values as those in Formulas 1 to 4.

Among the respective values in Formulas 5 to 8 described above, the in-pipe volume Vc of the heat exchanger that functions as the condenser, the in-pipe volume Ve of the heat exchanger that functions as the evaporator, and the in-pipe volumes Vo, βc, βe, and βl of the outdoor heat exchanger 22 are constants, which are similar to Formulas 1 to 4. Meanwhile, a2, b2, and c2 are factors determined by conducting the test.

The first term "ρc2×Vc", the second term "ρe2×Ve", and the third term "α2×Vo" in Formula 5, respectively, represent a refrigerant amount present in the outdoor heat exchanger 22 functioning as the condenser, a refrigerant amount present in the indoor heat exchangers 51*a* to 51*c* functioning as the evaporators, and a refrigerant amount present in the refrigerant circuit 100 excluding the outdoor heat exchanger 22 and the indoor heat exchangers 51*a* to 51*c* when the refrigerant supercooling degree is 0 deg and the refrigerant quality is 0 on the refrigerant outlet side of the outdoor heat exchanger 22 during the cooling operation under the rated conditions.

In addition, "α2" in the third term "α2×Vo" in Formula 5 is specifically a value obtained by multiplying an average density of refrigerant distributed in the refrigerant circuit 100 excluding the outdoor heat exchanger 22 and the indoor heat exchangers 51*a* to 51*c* under the rated conditions by a ratio of a volume of the refrigerant circuit 100 excluding the outdoor heat exchanger 22 and the indoor heat exchangers 51*a* to 51*c* to an in-pipe volume of the outdoor heat exchanger 22, obtained by dividing the volume of the refrigerant circuit 100 excluding the outdoor heat exchanger 22 and the indoor heat exchangers 51*a* to 51*c* by the in-pipe volume of the outdoor heat exchanger 22. Incidentally, the concept of "α2" is the same as that of "α1", and thus, the detailed description thereof will be omitted.

Next, a method for determining the factors a2, b2, and c2 used in Formulas 6 to 8 will be described. First, the refrigerant circuit 100 is charged with the lower-limit charge amount by the method described above, and then, the installation environment of the air conditioner 1 is changed from the overload conditions to the rated conditions described above (the outdoor dry-bulb temperature: 35° C./wet-bulb temperature 24° C. and the indoor dry-bulb temperature: 27° C./wet-bulb temperature: 19° C.) to resume the charging of refrigerant.

After resuming the charging of refrigerant, the refrigerant supercooling degree and the refrigerant quality on the refrigerant outlet side (at the point X in FIG. 1(A)) of the outdoor heat exchanger 22 are confirmed every predetermined time (for example, every 30 seconds). Incidentally, the refrigerant supercooling degree on the refrigerant outlet side of the supercooling heat exchanger 23 is obtained by subtracting a refrigerant temperature detected by the first liquid temperature sensor 35 from a high-pressure saturation temperature obtained using the high pressure (corresponding to the pressure Ph in FIG. 2(A)) detected by the discharge pressure sensor 31. In addition, the refrigerant quality is confirmed by visual observation by inserting, for example, a sight glass into the refrigerant outlet side of the outdoor heat exchanger 22 (using the confirmation method described above). Incidentally, regarding the above refrigerant supercooling degree, the CPU 210 of the outdoor unit control means 200 may acquire the high pressure detected by the discharge pressure sensor 31 and the refrigerant temperature detected by the first liquid temperature sensor 35 via the sensor input unit 240, and display the refrigerant supercooling degree calculated using the acquired high pressure and refrigerant temperature on a display unit (not illustrated) of the outdoor unit 2.

When the cooling operation is performed while charging the refrigerant, the outdoor expansion valve 24 of the outdoor unit 2 is fully opened, and each opening degree of the bypass expansion valve 29 of the outdoor unit 2 and the indoor expansion valves 52*a* to 52*c* of the indoor units 5*a* to 5*c* is adjusted such that the refrigerant supercooling degree on the refrigerant outlet side of the outdoor heat exchanger 22 described above becomes 0 deg. Incidentally, the outdoor fan 28 of the outdoor unit 2 and the indoor fans 55*a* to 55*c* of the indoor units 5*a* to 5*c* are driven in the same manner as when the lower-limit charge amount of refrigerant is charged.

The charging of refrigerant is progressed while performing the cooling operation as described above, the charging of refrigerant into the refrigerant circuit 100 is stopped if the refrigerant supercooling degree becomes 0 deg and the refrigerant quality becomes 0 on the refrigerant outlet side of the outdoor heat exchanger 22, and the decrease amount of weight of the refrigerant cylinder is set as the amount of charged refrigerant that is, the maximum cooling amount.

The above-described steps are performed for a plurality of types of combinations with different numbers and capabilities of indoor units connected to the outdoor unit 2 in the same manner as the case of obtaining the lower-limit charge amount. Further, the respective factors of a2, b2, and c2 are determined such that the upper-limit charge amount calculated by Formula 5 for each combination becomes the upper-limit charge amount obtained in the test conducted for each combination. As an example, a2=420, b2=180, and c2=290 in the case of R410A refrigerant. In addition, when the respective factors of a2, b2, and c2 are determined, ρc2, ρe2, and α2 can be calculated by Formulas 6 to 8 using these factors and βc, βe, and βl. For example, when the reference refrigerant and the use refrigerant are the same R410A refrigerant, βc=βe=βl=1, and thus, ρc2=420, ρe2=180, and α2=290.

<Charging of Refrigerant in Outdoor Unit 2>

The lower-limit charge amount and the upper-limit charge amount are obtained by the methods described above, and the refrigerant circuit 100 is charged with the amount of refrigerant within a range determined by the lower-limit charge amount and the upper-limit charge amount. Regarding the charging into the refrigerant circuit 100, the outdoor unit 2 may be fully charged with the amount of refrigerant within the range determined by the lower-limit charge amount and the upper-limit charge amount in the outdoor unit 2 at the time of producing the outdoor unit 2 and shipped when the calculated upper-limit charge amount is smaller than an upper limit amount of the refrigerant that can be charged in the outdoor unit 2 at the time of shipment (the upper limit amount is 12 kg in the International Maritime Dangerous Goods Codes) according to a regulation relating to the refrigerant charge amount (for example, "International Maritime Dangerous Goods Codes (IMDG)").

In addition, when the calculated lower-limit charge amount is larger than the upper limit amount determined by the above regulation relating to the refrigerant charge amount, the outdoor unit 2 may be charged with the above-described upper limit amount in the regulation at the time of producing the outdoor unit 2 and shipped, and then, a difference between the upper limit amount and the lower-limit charge amount may be charged at an installation site.

As described above, the amount of refrigerant charged in the refrigerant circuit 100 is set to the charge amount in the range determined by the lower limit amount and the maximum refrigerant amount in the air conditioner 1 of the present embodiment. As a result, the charge amount can be reduced while suppressing the refrigerant sound and the deterioration of controllability in the indoor expansion valves 52*a* to 52*c* caused by the small charge amount and ensuring the condensation capacity.

In the embodiment described above, the respective variables of Formulas 1 to 8 are obtained by the tests during the cooling operation of the air conditioner 1. This is because the more refrigerant amount is requested in the refrigerant circuit 100 during the cooling operation than during the heating operation in the air conditioner 1 of the present embodiment. That is, this is because the refrigerant condensed in the indoor heat exchangers 51*a* to 51*c* of the indoor units 5*a* to 5*c* is decompressed by the indoor expansion valves 52*a* to 52*c*, and flows into the outdoor unit 2 through the liquid pipe 8 in the gas-liquid two-phase state during the heating operation, but the refrigerant condensed in the outdoor heat exchanger 22 of the outdoor unit 2 is not decompressed (with the outdoor expansion valve 24 fully opened), and becomes the liquid refrigerant when flowing into the indoor units 5*a* to 5*c* through the liquid pipe 8 during the cooling operation.

In contrast, in an air conditioner in which a more refrigerant amount is requested in a refrigerant circuit during a heating operation than during a cooling operation, for example, in an air conditioner in which each indoor unit is not provided with an indoor expansion valve, an outdoor unit is provided with expansion valves as many as the number of the indoor units, and the outdoor unit and the respective indoor units are connected by sets of gas pipes and liquid pipes as many as the number of the indoor units, the air conditioner may perform the heating operation when the variables of Formulas 1 to 8 are obtained by tests. This is because, in such an air conditioner, refrigerant condensed in an outdoor heat exchanger of the outdoor unit is decompressed by each expansion valve and flows into each indoor unit through each liquid pipe in a gas-liquid two-phase state during the cooling operation, but refrigerant condensed in an indoor heat exchanger of each indoor unit is not decompressed (since each indoor unit is provided with no expansion valve), and becomes liquid refrigerant when flowing to the outdoor unit through each liquid pipe during the heating operation.

Incidentally, in the air conditioner in which the respective variables are determined during the heating operation as described above, a refrigerant charge amount when a refrigerant supercooling degree=0 deg and a refrigerant quality=0 on a refrigerant outlet side of all the indoor heat exchangers functioning as condensers becomes an upper-limit charge amount, and a refrigerant charge amount when a refrigerant supercooling degree=0 deg and a refrigerant quality=0 on a refrigerant inlet side of all the expansion valves becomes a lower-limit charge amount.

In addition, in a case where the outdoor unit 2 includes a plurality of the outdoor heat exchangers 22 or a plurality of the outdoor units 2 are provided in the air conditioner 1 of the present embodiment, a refrigerant charge amount when a refrigerant supercooling degree=0 deg and a refrigerant quality=0 on a refrigerant outlet side of all the outdoor heat exchangers 22 functioning as condensers becomes an upper-limit charge amount, and a refrigerant charge amount when a refrigerant supercooling degree=0 deg and a refrigerant quality=0 on a refrigerant inlet side of the indoor expansion valves 52*a* to 52*c* of the indoor units 5*a* to 5*c* becomes a lower-limit charge amount.

In addition, the respective variables of Formulas 1 to 8 in the embodiment described above have been exemplified in the case where each device condition of the air conditioner 1 has the above-described numerical value, but the respective variables of Formulas 1 to 8 change according to each device condition when each device condition of the air conditioner 1 is different from that of the present embodiment, for example, capabilities of the outdoor unit and indoor unit are different from those of the present embodiment or the number of indoor units connected to the outdoor unit is different.

In addition, the description has been given in the embodiment described above by assuming that the refrigerant supercooling degree and the refrigerant quality on the refrigerant outlet side of the supercooling heat exchanger 23 are the same as the refrigerant supercooling degree and the refrigerant quality on the refrigerant inflow side of the indoor expansion valves 52*a* to 52*c* when determining the factors a1, b1, and c1 used in Formulas 2 to 4 used to calculate the lower-limit charge amount. In contrast, when the supercooling heat exchanger 23 is not provided or a length of the liquid pipe 8 is long (for example, 20 m or more) and a pressure loss of refrigerant through the liquid pipe 8 is large, a temperature sensor and a sight glass may be provided on the refrigerant inflow side of the indoor expansion valves 52*a* to 52*c* to directly detect the refrigerant supercooling degree and the refrigerant quality on the refrigerant inflow side of the indoor expansion valves 52*a* to 52*c*.

REFERENCE SIGNS LIST

1 AIR CONDITIONER
2 OUTDOOR UNIT
5*a* to 5*c* INDOOR UNIT
20 COMPRESSOR
22 OUTDOOR HEAT EXCHANGER
23 SUPERCOOLING HEAT EXCHANGER
24 OUTDOOR EXPANSION VALVE
29 BYPASS EXPANSION VALVE
31 DISCHARGE PRESSURE SENSOR
35 FIRST LIQUID TEMPERATURE SENSOR
36 SECOND LIQUID TEMPERATURE SENSOR
51*a* to 51*c* INDOOR HEAT EXCHANGER
52*a* to 52*c* INDOOR EXPANSION VALVE
100 REFRIGERANT CIRCUIT
200 OUTDOOR UNIT CONTROL MEANS
210 CPU
220 STORAGE UNIT

The invention claimed is:

1. An air conditioner comprising: an outdoor unit configured to have a compressor and an outdoor heat exchanger; an indoor unit configured to have an indoor heat exchanger, the outdoor unit and the indoor unit connected by a liquid pipe and a gas pipe to constitute a refrigerant circuit; and an expansion valve provided in at least one of the indoor unit and the liquid pipe, wherein the outdoor unit is configured to have a supercooling heat exchanger that cools refrigerant flowing out of the outdoor heat exchanger that functions as a condenser, wherein the air conditioner is configured to charge a charge amount of refrigerant in the refrigerant circuit, the charge amount being larger than a lower-limit charge amount and smaller than an upper-limit charge amount, and configured to perform a cooling operation by using the charge amount of refrigerant, wherein the upper-limit charge amount is a charge amount that a refrigerant supercooling degree at a refrigerant outlet of the outdoor heat exchanger that functions as the condenser is 0 deg when the expansion valve is adjusted such that a refrigerant superheating degree at the refrigerant outlet of the indoor heat exchanger becomes a predetermined target refrigerant superheating degree while performing the cooling operation under a predetermined cooling rated condition, and wherein the lower-limit charge amount is a charge amount that refrigerant at a refrigerant inlet of the expansion valve is liquid single-phase refrigerant when the expansion valve is adjusted such that the refrigerant superheating degree at the refrigerant outlet of the indoor heat exchanger becomes a predetermined target refrigerant superheating degree while performing the cooling operation under a predetermined cooling overload condition, which is an upper-limit temperature condition of each of dry-bulb temperature and wet-bulb temperature outside and inside a room where the air conditioner is capable of performing the cooling operation.

* * * * *